US007669716B2

(12) United States Patent
Lightner et al.

(10) Patent No.: US 7,669,716 B2
(45) Date of Patent: Mar. 2, 2010

(54) CONTAINER ASSEMBLY FOR PACKAGING PRODUCTS

(75) Inventors: Robert E. Lightner, Jones, MI (US); Mike McFarland, Elkhart, IN (US); Scott Duehmig, Elkhart, IN (US); Peter Giczewski, Granger, IN (US)

(73) Assignee: Barger Packaging, Elkhart, IN (US)

( * ) Notice: Subject to any disclaimer, the term of this patent is extended or adjusted under 35 U.S.C. 154(b) by 421 days.

(21) Appl. No.: 11/673,160

(22) Filed: Feb. 9, 2007

(65) Prior Publication Data

US 2008/0190805 A1 Aug. 14, 2008

(51) Int. Cl.
*B65D 81/07* (2006.01)
*A61B 19/02* (2006.01)

(52) U.S. Cl. ..... 206/583; 206/438

(58) Field of Classification Search ..... 206/438, 206/569, 570–572, 363–370, 521, 583, 588
See application file for complete search history.

(56) References Cited

U.S. PATENT DOCUMENTS 4,491,225 A * 1/1985 Baillod ..... 206/583
4,759,444 A 7/1988 Barmore
5,183,159 A 2/1993 Hojnacki
5,251,760 A * 10/1993 Smith et al. ..... 206/583
5,868,253 A * 2/1999 Krueger et al. ..... 206/438
6,880,706 B2 * 4/2005 Braconnot et al. ..... 206/438

* cited by examiner

*Primary Examiner*—J. Gregory Pickett
(74) *Attorney, Agent, or Firm*—Taft Stettinius & Hollister LLP; Keith Swedo

(57) ABSTRACT

A container member including a rigid cup portion defining a chamber. The container member has an opening at one end in communication with the chamber and a flexible suspension member extending over the opening. The suspension member has an inner surface facing the chamber, an opposing outer surface and a cavity extending from the outer surface to the inner surface. The cavity is in communication with the chamber and sized to receive at least a portion of the product to be packaged therethrough. The container assembly includes a retainer having a retaining member removably positioned to extend over the cavity. The retaining member holds the at least a portion of the product in position in the chamber such that the at least a portion of the product does not contact the cup portion.

13 Claims, 7 Drawing Sheets

CONTAINER ASSEMBLY FOR PACKAGING PRODUCTS

BACKGROUND

The present invention relates to containers for packaging products for transport and, more particularly, to containers for packaging products having surfaces or components that are sensitive to abrading and/or should avoid exposure to debris and particulate matter.

When transporting products from one place to another, products are often packaged in protective containers to avoid damage to, and breakage of, products during shipment. In the particular case of medical device products, such as prosthetic components, it is especially important that the packaging containers protect the products from damage. For instance, knee prosthetic components typically include articulating surfaces which are designed to be smooth. These surfaces must be protected during shipment in order to avoid abrading of the articulating surfaces and to maintain the smooth characteristic of the articulating surfaces. Some prosthetic components, such as the stem, have porous surface designed to promote bone ingrowth. These surfaces are rough and, if allowed to move against the packaging, can abrade the packaging container. Abrading of the packaging container, itself, should also be avoided because such abrading may create debris and particulate matter, which can become lodged in the porous surfaces of the medical product and can give the medical product a dirty or contaminated appearance.

Packaging containers have been formed of materials such as polyethylene glycol (PEG), foam, paper and cardboard and are typically designed to surround or nest the product within the material, thereby securing and padding the products being shipped. Unfortunately, some of these packaging containers and designs may still abrade the surfaces of the product. In addition, the friction caused by the movement of the product against the packaging may cause the formation of undesirable particulate matter.

Accordingly, a need remains for improved packaging containers that further minimize abrading of both the product and the container, and minimize the formation of particulate matter.

SUMMARY

The present invention provides packaging containers, assemblies and products for packaging objects. In one form, the invention provides a container assembly for packaging a medical product having a first portion and a second portion. The container assembly includes a container member having a cup portion formed by a cup wall. The cup wall defines a chamber, and the cup portion has an opening at one end in communication with the chamber. A suspension member is coupled to the container member and extends over the opening. The suspension member has an inner surface facing the chamber, an opposing outer surface and a cavity extending from the outer surface to the inner surface. The cavity is in communication with the chamber and is sized to receive the first portion of the medical product therethrough but maintain the second portion of the medical product outside of the chamber. The container assembly also includes a retainer having a retaining member. The retainer is positionable in a secured position wherein the retaining member extends over the cavity and the second portion of the medical product thereby clamping the second portion of the medical product between the outer surface of the suspension member and the retaining member. When the retainer is in the secured position, the first portion of the medical product is suspended in the chamber and is out of contact with the cup wall.

In another form, the invention provides a non-abrading container assembly for packaging a product having a first portion and a second portion. The container assembly includes a container member having a rigid cup portion defining a lower chamber and a rigid rim portion defining an upper chamber. The cup portion has an opening at one end such that the upper chamber is in communication with the lower chamber through the opening. The container member includes a flexible suspension member coupled to the rim portion and extending over the opening between the upper and lower chambers. The suspension member has an inner surface facing the lower chamber, an opposing outer surface and a cavity extending from the outer surface to the inner surface. The cavity is in communication with the chamber and is sized to receive the first portion of the product therethrough but maintain the second portion of the product outside of the chamber. The container assembly also includes a retainer positionable in the upper chamber and having a retaining member. The retainer member extends over the cavity and the second portion of the product when the retainer is positioned in the upper chamber thereby clamping the second portion of the product between the outer surface of the suspension member and the retaining member.

In still another form, non-abrading container assembly includes a container member including a rigid cup portion defining a chamber. The container member has an opening at one end in communication with the chamber and a flexible suspension member extending over the opening. The suspension member has an inner surface facing the chamber, an opposing outer surface and a cavity extending from the outer surface to the inner surface. The cavity is in communication with the chamber and sized to receive at least a portion of the product therethrough. The container assembly further includes a retainer having a retaining member removably positioned to extend over the cavity. The retaining member holds the at least a portion of the product in position in the chamber such that the at least a portion of the product does not contact the cup portion.

In yet another form, the non-abrading container assembly includes a first container member and a second container member. The first container member includes a rigid cup portion defining a first chamber and a rigid rim portion defining a second chamber. The first chamber has an opening at one end in communication with the second chamber. The second container member is configured to be substantially received within the second chamber and includes a second rigid cup portion defining third chamber. The third chamber has a second opening at one end. When the second container member is substantially received within the second chamber, the third chamber is in alignment with the first chamber and the first and third chambers combined are configured to contain the product. The container assembly also includes a first retaining sheet extending over the opening, and a second retaining sheet extending over the second opening. A locking member secures the second container member within the second chamber of the first container.

wherein at least one of said first and second retaining sheets is flexible and is adapted to stretch about the product.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
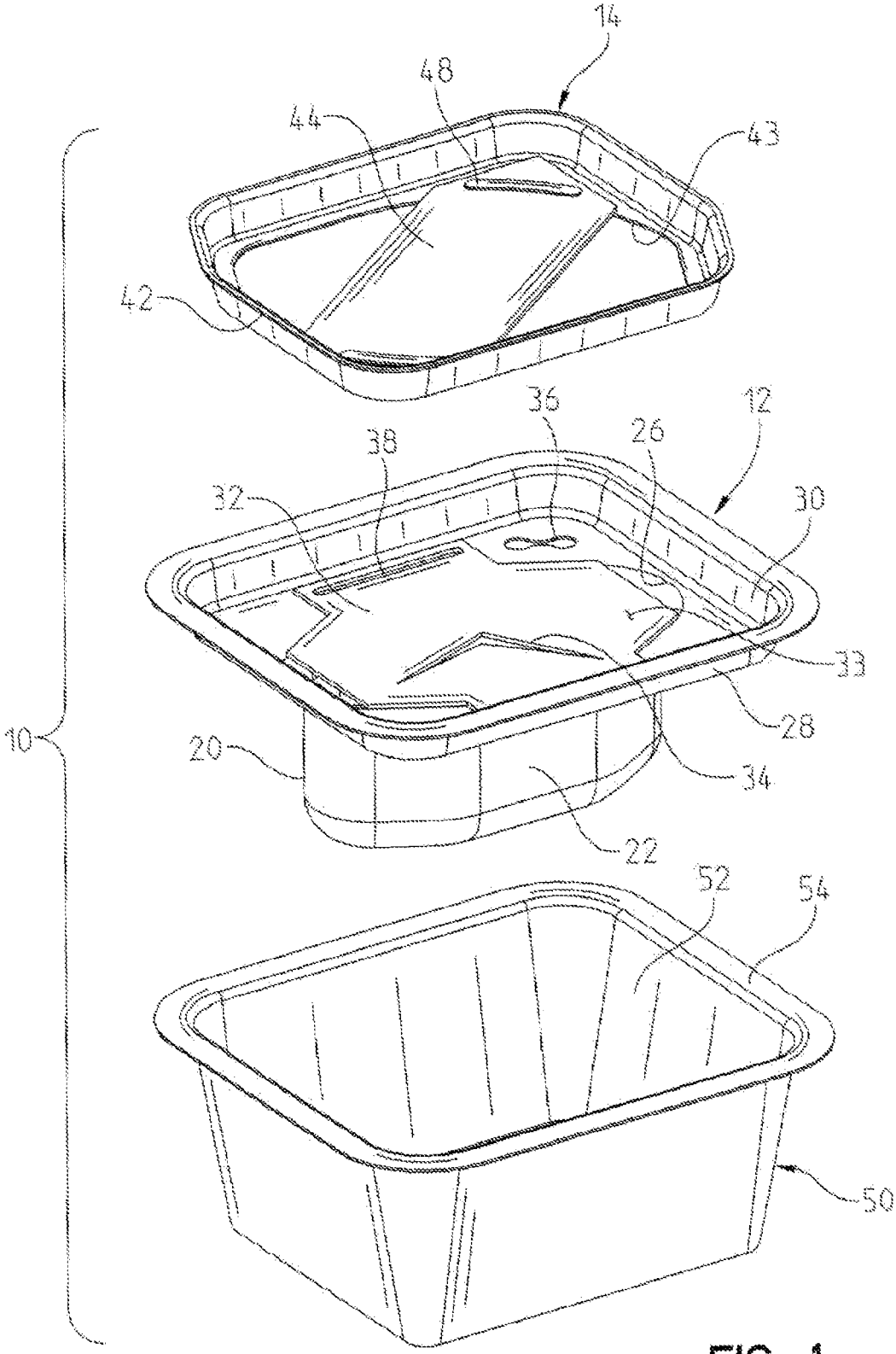
FIG. 1 is an exploded view of a packaging container assembly in accordance with one embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

Figure 2:
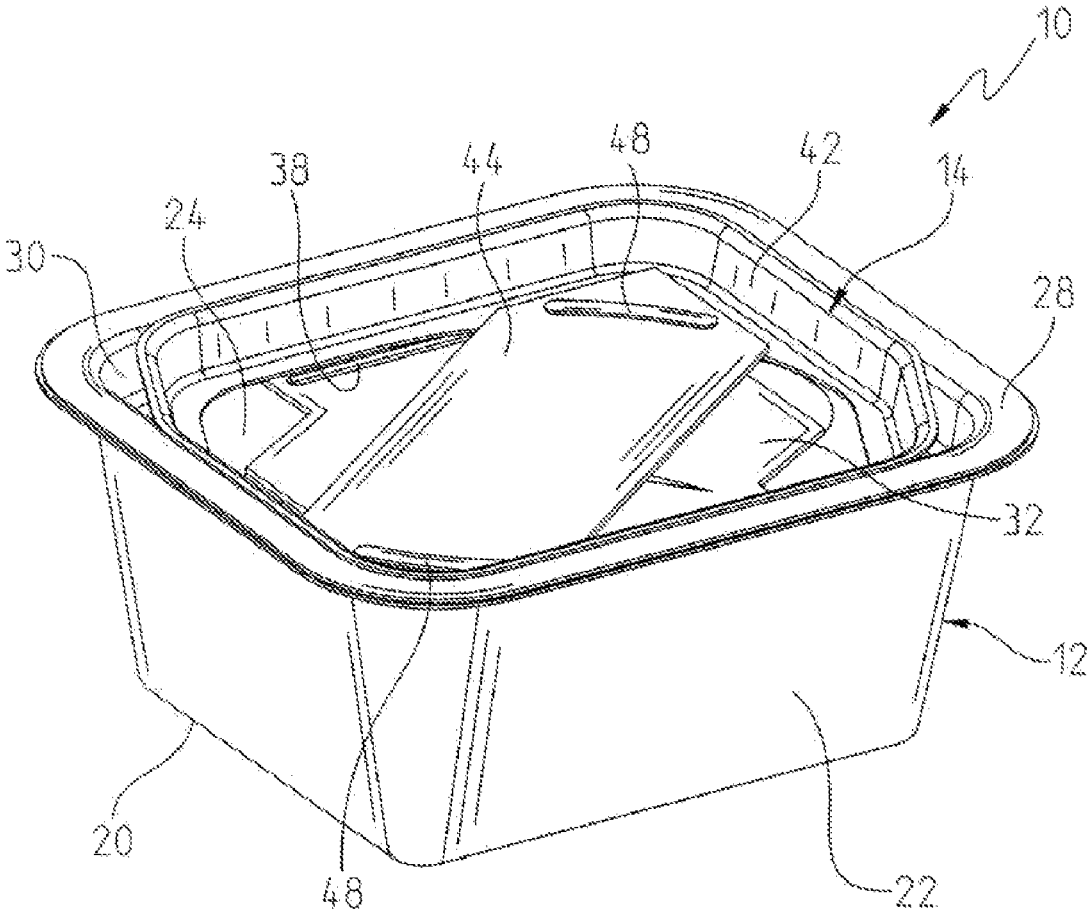
FIG. 2 is a perspective view of the container member and retainer assembly of the packaging container assembly of FIG. 1.

Referring first to FIGS. 1 and 2, container assembly 10 according to one embodiment of the present invention will now be described. Container assembly 10 generally includes container member 12, retainer 14 and optional shell 50.

Figure 3:
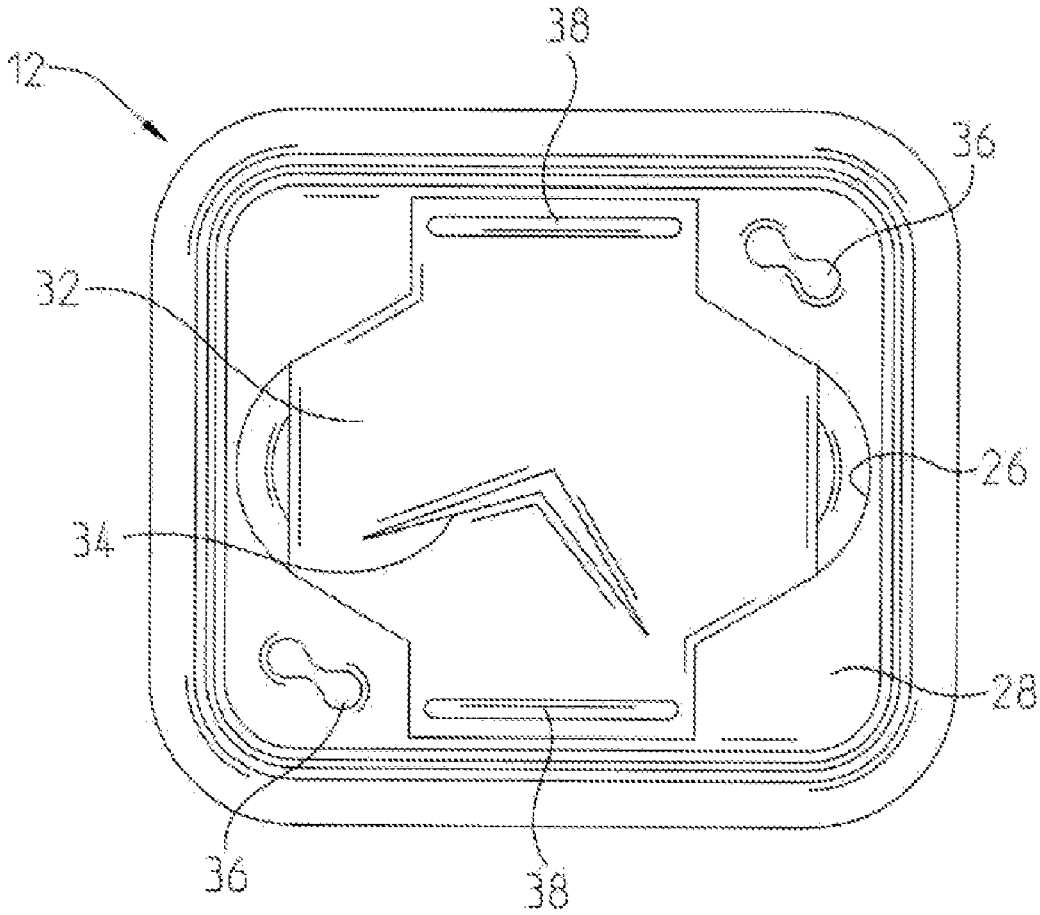
FIG. 3 is a top view of the container member of FIG. 2.
Figure 5:
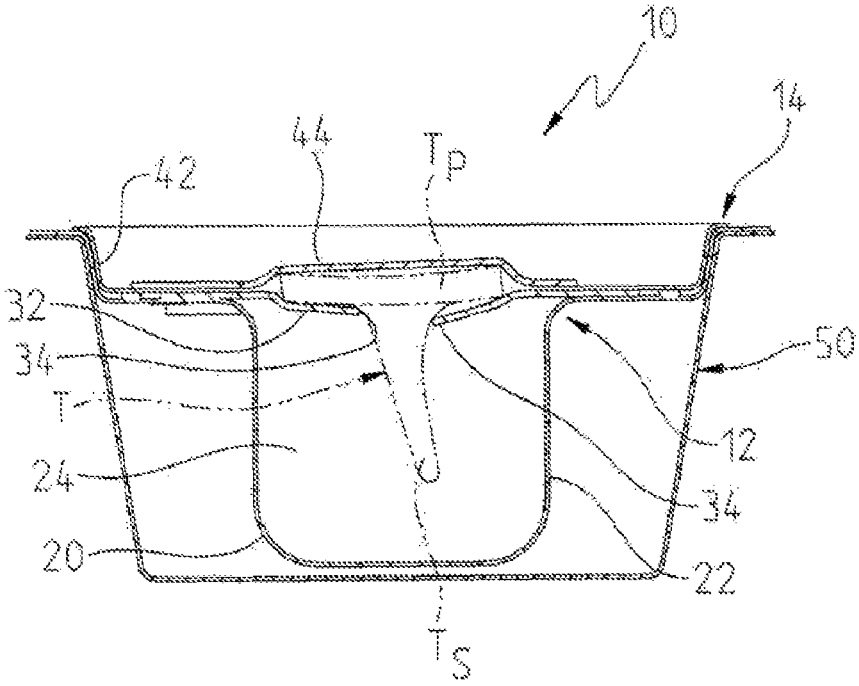
FIG. 5 is a sectional view of the container member and retainer assembly of FIG. 2.
Figure 6:
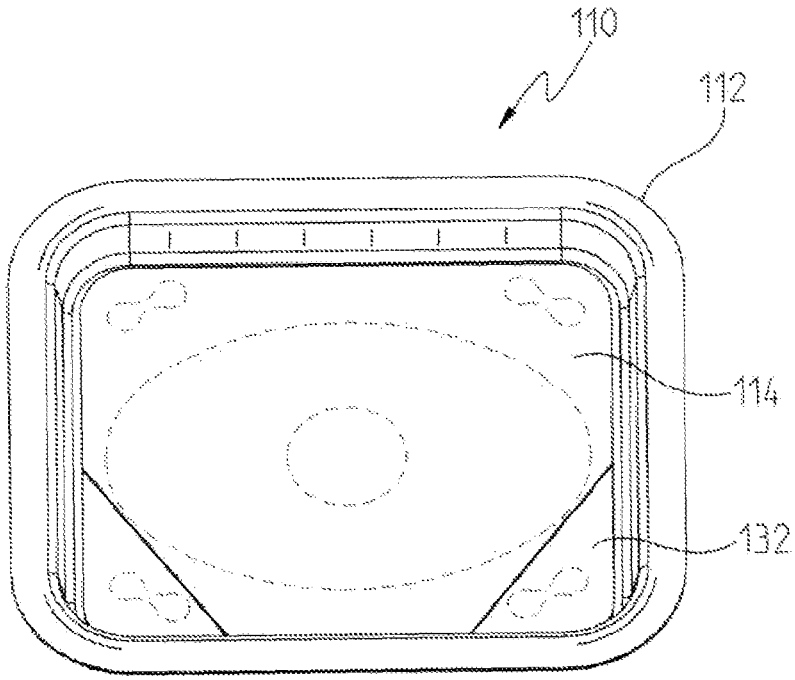
FIG. 6 is a top perspective view of a packaging container assembly according to another embodiment of the present invention.

As illustrated in FIGS. 1-3, container member 12 includes cup portion 20 having cup wall 22, which defines main chamber 24 (FIG. 5). As discussed in further detail below, main chamber 24 is sized to spatially and loosely receive and house therein at least a portion of the object to be packaged. Cup portion 20 also includes opening 26 at one end. Opening 26 is in communication with main chamber 24. Container member 12 further includes rim portion 28 extending from and about opening 26 to form upper chamber 30. Upper chamber 30 is in communication with main chamber 24 through opening 26. Container member 12 also includes female connectors 36 in the form of a pair of recesses disposed in opposing corners of rim portion 28. Cup portion 20 and rim portion 28 of container member 12 may be formed integrally as a single unit and may be formed of any material capable of protecting the object disposed/packaged in chamber 24. In one particular embodiment, cup portion 20 and rim portion 28 are formed of a rigid material such as plastic and, more particularly, of polyethylene glycol (PEG).

Suspension member or pad 32 is coupled to rim portion 28 and extends over opening 26. More particularly, suspension member 32 is coupled at opposite ends to rim portion 28 at seams 38 located adjacent opposing sides of opening 26. Suspension member 32 has an inner surface (not shown) facing chamber 30 and opposing outer surface 33. Suspension member 32 includes cavity 34 extending therethrough from outer surface 33 to inner surface. Cavity 34 provides communication between main chamber 24 and upper chamber 30 and is sized to receive a portion of the object to be packaged therethrough. Cavity 34 may be any size or shape including, as shown in FIG. 1, a V-shaped slit.

Figure 4:
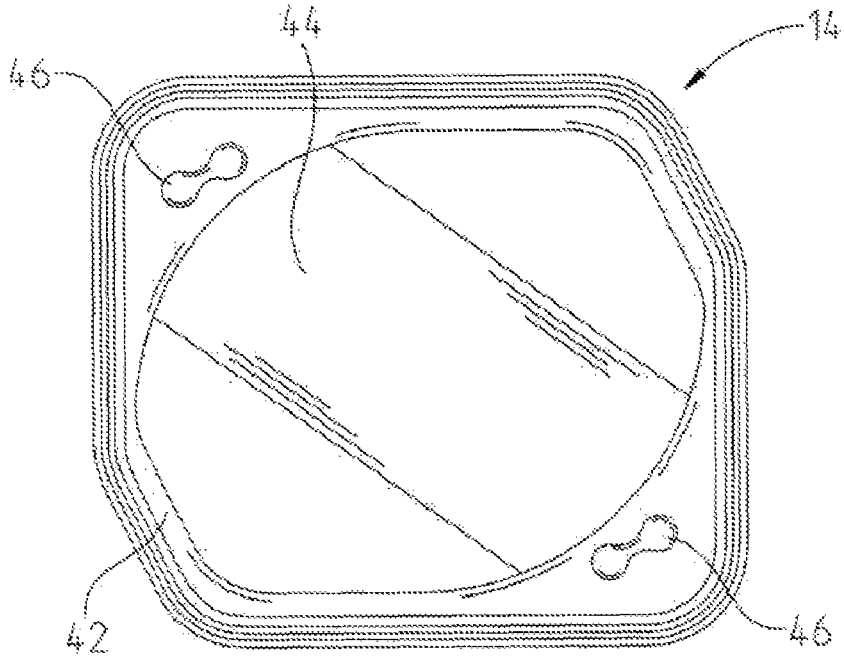
FIG. 4 is a bottom view of the retainer of the packaging container assembly of FIG. 1.

Turning now to FIGS. 1, 2 and 4, retainer 14 generally includes frame 42, aperture 43 extending through frame 42, and retaining member or strap 44 coupled at its ends to frame 42 and extending over aperture 43. Frame 42 is sized and configured to fit within upper chamber 30 of container member 12, and includes male connectors 46 in the form of projections disposed at opposing corners of frame 42. Male connectors 46 are sized and configured to snap-fit within female connectors 36 of container member 12. As illustrated in FIG. 2, retaining strap 44 is coupled to frame 42 at seams 48.

Referring to FIG. 1, optional shell 50 defines open-ended compartment 52, which is sized and configured to receive cup portion 20 of container member 12. Shell 50 includes flange 54 extending from and about the open end of compartment 52.

Turning now to FIGS. 1 and 5, the use of container assembly 10 will now be described. Container assembly 10 is particularly useful for packaging products that have surfaces sensitive to abrading and/or that have features sensitive to exposure to particulate matter. For instance, tibial component T of a knee prosthesis often includes tibial plate $T_p$ and tibial stem $T_s$ extending from the bottom of tibial plate $T_p$. Tibial stem $T_s$ is designed to be inserted into a canal bored into the proximal end of the tibia bone and may have a porous surface for promoting the ingrowth of bone. Tibial plate $T_p$, on the other hand, may have smooth surfaces for articulating with a bearing component.

To package and protect tibial component T for transport, tibial stem $T_s$ is inserted through cavity 34 in suspension member 32 and through opening 26 until tibial plate $T_p$ rests against outer surface 33 of suspension member 32. In this particular embodiment, cavity 34 is sized to receive tibial stem $T_s$ therethrough, but not tibial plate $T_p$. As a result, tibial plate $T_p$ is disposed within upper chamber 30 and supported on outer surface 33 of suspension member 32, while tibial stem $T_s$ is suspended within chamber 24 such that tibial stem $T_s$ does not contact cup wall 22. To firmly secure tibial component T in this position, retainer 14 is inserted into upper chamber 30, such that tibial plate $T_p$ extends through aperture 43 and retaining strap 44 extends across tibial plate $T_p$. Male connectors 46 (FIG. 4) are aligned with female connectors 36 and are snap-fit within female connectors 38 to thereby secure retainer 14 to container member 10 and bracing tibial plate $T_p$ between suspension member 32 and retaining strap 44. The assembly of retainer 14 and container member 12 may then be placed into compartment 52 of shell 50, sterilized and hermetically sealed.

As discussed above, the object (tibial component T) to be packaged is secured in container assembly 10 by, is in contact with and is braced between suspension member 32 and retaining strap 44. To minimize the formation of particulate matter and to prevent abrading of the object, suspension member 32 and retaining strap 44 may be formed of any material that is substantially non-abrading and resists forming particulate matter when exposed to friction by the object. In addition, in order to accommodate objects of varying sizes and shapes, the material forming suspension member 32 and retaining strap 44 may also be flexible or semi-flexible. For example, suspension member 32 and retaining strap 44 may be formed of plastic, rubber or other material. In one particular embodiment, suspension member 32 and retaining strap 44 are formed of ST-1880 polyether, polyurethane available from Steven Urethane of Easthampton, Mass., U.S.A.

During transport, the rigid cup portion and rim portion protect the tibial component from damage from outside forces, while the resilient, non-abrading retaining strap and suspension member hold tibial component in position. Because the tibial component only contacts the resilient, non-abrading material of retaining strap 44 and suspension member 32, and does not contact the rigid portions, the surfaces of the tibial are preserved and the formation of particulate matter from abrading of either the tibial component or the container assembly is minimized.

The flexible suspension member 32 and retaining strap 44 may be coupled to rim portion 28 and retainer frame 42, respectively, by any affixation means. For instance flexible suspension member 32 and retaining strap 44 may be coupled to rim portion 28 and retainer frame 42 by radio frequency (RF) welding, crimping, adhesive, heat welding, sonic welding, or other means. As illustrated in FIGS. 1 and 2, flexible suspension member 32 and retaining strap 44 are RF welded to rim portion 28 and retainer frame 42, respectively, at seams 38 and 48, respectively.

It should be understood that, although the figures illustrate cavity 34 of suspension member 32 as being a V-shaped slit, cavity 34 may be of any shape or design. The V-shaped slit may be beneficial to receive tibial stems (or other components of objects to be packaged) having various sizes and shapes. Furthermore, the present invention is not limited to use in packaging tibial components, but may be configured and sized to package other medical device components, such as femoral components, shoulder (humeral or glenoid components) prosthetics, hip prosthetics (femoral shaft or acetabular cup components), elbow prosthetic components, modular long bone components, bone plates, spine prosthetic components and other orthopedic implant components. Furthermore, the present invention is also not limited for use in packaging orthopedic implants, but may be used for packaging any medical device component. The present invention may also be configured for use in packaging objects other than medical devices.

Furthermore, female and male connectors 36, 46 need not be positioned on container member 12 and retainer 14 respectively. Rather, the arrangement of female and male connectors 36, 46 may be reversed in that female connectors 36 may be disposed on retainer 14 while male connectors 46 may be disposed on container member 12. In still another alternative, other connection mechanisms may be used to secure retainer 14 to container member 12. For instance, retainer member 14 may be hingedly attached at one side to container member 12 and a tab or snap may be used at the opposing side to lock the hinging retainer in the closed position.

Finally, the components of container assembly may be formed using any known methods. For example, the cup portion and retainer frame may be molded, machined, stamped, or vacuum-pressed. The flexible suspension member and retaining strap may be similarly formed.

Figure 7:
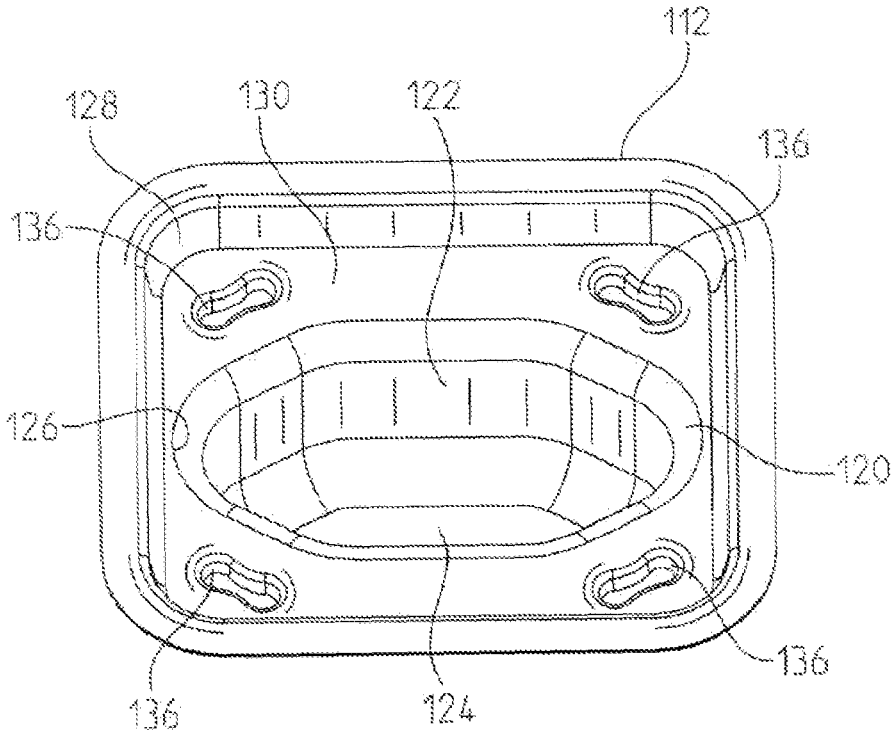
FIG. 7 is a top perspective view of the container member of the packaging container assembly of FIG. 6.

Turning now to FIGS. 6-9, another embodiment of the present invention is illustrated. Container assembly 110 generally includes container member 112, suspension member 132 and retainer 114. Referring, particularly, to FIG. 7, container member 112 includes cup portion 120 having cup wall 122, which defines main chamber 124. Container member 112 further includes rim portion 128, which forms upper chamber 130. Main chamber 124 has an opening 126 at one end, and main chamber 124 is in communication with upper chamber 130 through opening 126. Rim portion 128 includes female connectors or recesses 136 disposed at each corner of rim portion 128.

Figure 9:
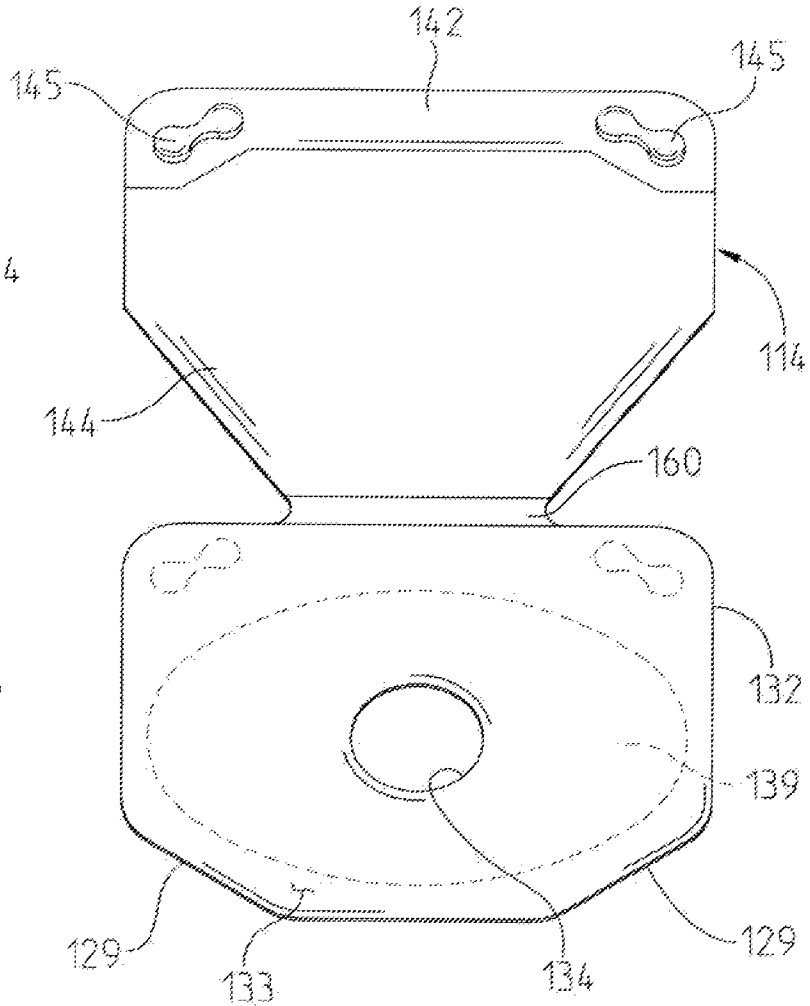
FIG. 9 is a bottom view of the retainer-suspension member assembly of FIG. 8.
Figure 8:
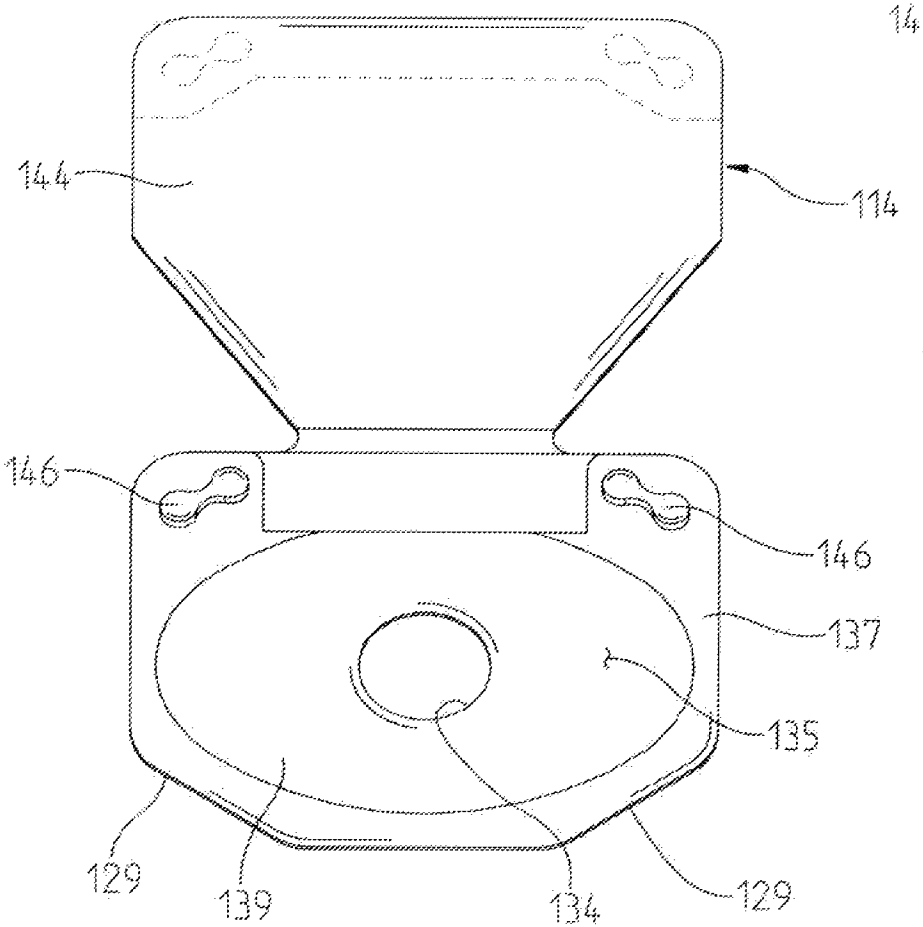
FIG. 8 is a top view of the retainer-suspension member assembly of the packaging container assembly of FIG. 6.

Turning now to FIGS. 8 and 9, suspension member 132 includes rigid frame piece 137 and flexible suspension pad 139, which is coupled to frame piece 137. Suspension pad 139 includes inner surface 135, opposing outer surface 133 and cavity 134 extending therethrough from inner surface 135 to outer surface 133. Cavity 134 is configured to receive therethrough at least a portion of the product to be packaged. Frame piece 137 is coupled to inner surface 135 of suspension pad 139 and includes a pair of male connectors or projections 146 projecting therefrom. Male connectors 146 are configured to be received in female connectors 136 in container member 112.

Referring still to FIGS. 8 and 9, retainer 114 includes rigid frame piece 142 and flexible retaining piece 144 coupled to frame piece 142. A pair of male connectors 145 project from frame piece 142 and are configured to be received in female connectors 136 in container member 112. Retainer 114 is hingedly coupled to suspension member 132 by living hinge 160, such that retainer member 114 may be folded over outer surface 133 of suspension member 132. As shown in FIGS. 8 and 9, suspension member 132 has angled corners 129, such that when retainer 114 is folded over suspension member, male connectors 145 are positioned outside angled corners 129 and can extend beyond suspension member 132.

In use, suspension member 132 is coupled to container member 112 by snap fitting male connectors 146 in two of female connectors 136 of container member 112. See FIGS. 6-10. The product to be packaged (not shown), such as tibial component T (FIG. 5), is placed atop suspension member 132 with a portion of the product, such as tibial stem $T_s$ (FIG. 5), extending through cavity 134, thereby suspending that portion of the product within main chamber 124. Then, retainer 114 is folded, via hinge 160, over suspension member 132 and the product (not shown). Male connectors 145 are then snap fit into the remaining two female connectors 136 in container member 112, thereby securing retainer 114 to container member 112 and clamping the product between retainer 114 and suspension member 132.

Figure 10:
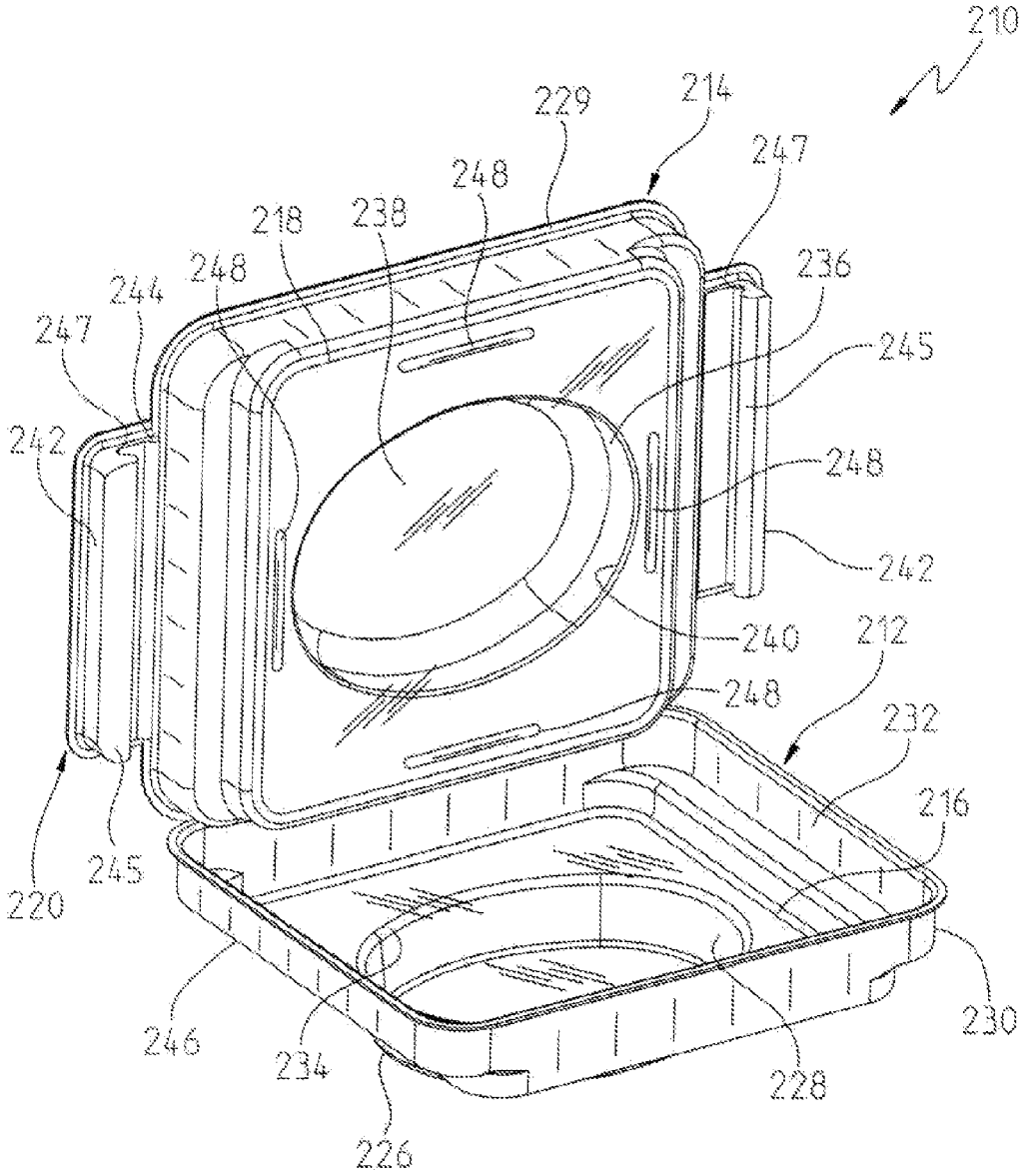
FIG. 10 is a perspective view of a packaging container assembly according to another embodiment of the present invention.

Turning now to FIG. 10, container assembly 210, according to yet another embodiment of the present invention, is illustrated. Container assembly 210 generally includes first container member 212, second container member 214, first retaining sheet 216, second retaining sheet 218 and locking member 220. First and second container members 212, 214 include rigid cup portions 226, 236, respectively. Cup portions 226, 236 define respective chambers 228, 238, which have respective openings 234, 240 at one end.

First container member 212 also includes rigid rim portion 230, which defines second or upper chamber 232. Upper chamber 232 is configured to substantially receive second container member 214 therein. In other words, upper chamber 232 is sized and shaped to receive substantially all of second container member 214, except for small flange 229 extending from and about the perimeter rim portion 230. In some embodiments, cup portion 226 may be sized to accommodate larger products and, therefore, cup portion 236 may not be entirely contained within upper chamber 232 when second container member 214 is disposed within upper chamber 232 of first container member 212. Nevertheless, in such an embodiment a substantial portion of cup portion 236 is received within upper chamber 232 of first container member 212.

Referring still to FIG. 10, first and second retaining sheets 216, 218 are respectively coupled to first and second container members 212, 214 and extend over openings 234, 240, respectively. First and second retaining sheets 216, 218 are formed of a relatively thin, flexible, non-abrading material, such as plastic, polyurethane, rubber or other material. As is discussed in further detail below, first and second retaining sheets 216, 218 are designed to stretch about and hold the product to be packaged, and may be formed of any material suitable therefor. First and second retaining sheets 216, 218 may be coupled to respective first and second container members 212, 214 using any known means including adhesive, RF welding, crimping, sonic welding, heat sealing or other means.

Referring still to FIG. 10, latch mechanism 220 generally includes a pair of latches 242 hingedly coupled to opposite ends of second container member 214 via living hinge 244. Latch mechanism 220 also includes latch engaging member in the form of lip 246 formed in rim portion 230 at opposite ends of first container member 212. Latches 242 each include hook portion 245 configured to engage lip 246. More particularly, hook portion 245 includes groove 247 which is configured to receive lip 246.

In use, the product to be packaged (not shown) is placed in second chamber 232 of first container member 212 atop first retaining sheet 216 and is positioned over opening 234 of chamber 228. Second container member 214 is then inserted into second chamber 232 of first container member 212 such that chambers 228 and 238 are aligned and second retaining sheet 218 contacts the product. As second container member 214 is further inserted into chamber 232, retaining sheets 216, 218 stretch about the product (not shown) thereby clamping the product between sheets 216, 218 and suspending the product within aligned chambers 228, 238. First and second container members 212, 214 are secured in this position by hinging latches 242 downward until hook 245 engages lip 246. It should be understood that any latch mechanism may be used to secure first container member 212 to second container member 214.

As illustrated in FIG. 10, first and second container members 212, 214 may be hingedly coupled to one another by a living hinge (not shown) or other hinge mechanism to allow for easy use. Alternatively, first and second container members 212, 214 may be separate from one another until assembled to pack the product.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A non-abrading container assembly for packaging a product, the product having a first portion and a second portion, the container assembly comprising:

a container member including a rigid cup portion defining a lower chamber and a rigid rim portion defining an upper chamber, said cup portion having an opening at one end such that said upper chamber is in communication with said lower chamber through said opening, a flexible suspension member coupled to said rim portion and extending over said opening and disposed between said upper and lower chambers, said suspension member having an inner surface facing said lower chamber, an opposing outer surface and a cavity extending from said outer surface to said inner surface, said cavity in communication with said chamber, said cavity sized to receive the first portion of the product therethrough but maintain the second portion of the product outside of said cavity; and a retainer positioned in said upper chamber and having a retaining member, said retainer member extending over both said cavity and the second portion of the product when said retainer is positioned in said upper chamber thereby clamping the second portion of the product between the outer surface of said suspension member and said retaining member.

2. The container assembly of claim 1 wherein said suspension member is removably coupled to said container member.

3. The container assembly of claim 1 wherein said suspension member is hingedly coupled to said retainer.

4. The container assembly of claim 1 wherein said retainer is removably positioned in said upper chamber and one of said retainer and said container member includes a female connector and the other of said retainer and said container member includes a male connector, said female connector configured to receive said male connector to removably couple said retainer to said container member.

5. The container assembly of claim 1 wherein said suspension member is removably coupled to said container member and one of said suspension member and said container member includes a female connector and the other of said suspension member and said container member includes a male connector, said female connector configured to receive said male connector to removably couple said suspension member to said rim portion.

6. The container assembly of claim 1 wherein said container member is formed of a first rigid material and said suspension member is formed of a second material, said second material is flexible relative to said first material.

7. The container assembly of claim 6 wherein said second material comprises polyurethane.

8. The container assembly of claim 6 wherein said second material comprises ST-1880 polyether polyurethane.

9. The container assembly of claim 6 wherein said first material comprises PEG.

10. The container assembly of claim 1 wherein said cavity is a slit in said retaining member.

11. A non-abrading container assembly for packaging a product, the container assembly comprising:

a first container member including a rigid cup portion defining a first chamber and a rigid rim portion defining a second chamber, said first chamber having an opening at one end in communication with said second chamber;

a second container member configured to be substantially received within said second chamber and including a second rigid cup portion defining third chamber, said third chamber having a second opening at one end, when said second container member is substantially received within said second chamber said third chamber is in alignment with said first chamber and said first and third chambers combined are configured to contain the product;

a first retaining sheet extending over said opening;

a second retaining sheet extending over said second opening; and a locking member securing said second container member within said second chamber of said first container wherein at least one of said first and second retaining sheets is flexible and is adapted to stretch about the product.

12. The container assembly of claim 11 wherein said locking member includes a pair of latches hingedly coupled to opposite ends of one of said first and second container members and a pair of latch engaging members disposed on opposite ends of the other of said first and second container members, said pair of latches engaging said latch engaging members to secure said second container member within said second chamber.

13. The container assembly of claim 11 wherein said first container member is hingedly coupled to said second container member.

* * * * *